US007556494B2

(12) United States Patent
Huang

(10) Patent No.: US 7,556,494 B2
(45) Date of Patent: Jul. 7, 2009

(54) CHILD RESISTANT LIGHTER

(76) Inventor: Xinhua Huang, No. 239, Northern The Third Circular Road, East, Cixi, Ningbo, Zhejiang Province (CN) 315600

( * ) Notice: Subject to any disclaimer, the term of this patent is extended or adjusted under 35 U.S.C. 154(b) by 107 days.

(21) Appl. No.: 11/712,525

(22) Filed: Mar. 1, 2007

(65) Prior Publication Data

US 2008/0213712 A1 Sep. 4, 2008

(51) Int. Cl.
*F23D 11/36* (2006.01)

(52) U.S. Cl. ..... 431/153; 431/255; 431/344; 431/345

(58) Field of Classification Search ..... 126/258, 126/401–409; 222/153.14, 402.11; 251/89, 251/89.5, 95, 106; 431/153, 254, 255, 277, 431/344, 345

See application file for complete search history.

(56) References Cited

U.S. PATENT DOCUMENTS 6,046,528 A * 4/2000 LaForest et al. ..... 310/339
6,050,811 A * 4/2000 Stein ..... 431/153
6,213,759 B1 * 4/2001 Sung ..... 431/153
6,244,858 B1 * 6/2001 Wang ..... 431/153
6,837,703 B2 * 1/2005 Saito ..... 431/153
7,175,425 B2 * 2/2007 Sung ..... 431/153
2005/0023301 A1 * 2/2005 Rumrill et al. ..... 222/391
2005/0196717 A1 * 9/2005 Wong ..... 431/153
2005/0239008 A1 * 10/2005 Sung ..... 431/153
2007/0009843 A1 * 1/2007 Di Paolo ..... 431/153

* cited by examiner

*Primary Examiner*—Steven B McAllister
*Assistant Examiner*—Daniel E Namay

(57) ABSTRACT

A child resistant lighter has a hollow handle, a barrel mounted in the handle, a fuel tank and a piezoelectric unit contained in the handle, an ignition device, and a safe device. A user is able to hold the handle and then pull a slidable button of the safe device with his forefinger and push an ignition button of the ignition device with his thumb at the same time. The safe lighter is able to both lower a possibility of unintentional ignition by child and protect a skin of thumb of a user.

2 Claims, 3 Drawing Sheets

CHILD RESISTANT LIGHTER

BACKGROUND OF THE INVENTION

1. Field of the Invention

The invention relates to a child resistant lighter, more particularly, to a child resistant electronic gas lighter which is able to both lower a possibility of unintentional ignition by child and protect a skin of thumb of a user.

2. Description of the Prior Art

One kind of conventional child resistant lighter has a safe means which has to be first unlocked before a trigger of the lighter able to be pulled. For example, in a child-proof safe lighter disclosed in Chinese patent application numbered 02160665.x, a trigger and a safe button have to be pressed down at the same time to ignite. Such lighters are not safe enough since they are still easy for children to find the way to ignite.

A kind of improved lighters having a safe means which has to be unlocked with a certain force which children usually do not have has been provided then. For example, a Chinese patent 00111699.1 named "A Lighter with Safe Locking Means" disclosed a lighter having a trigger and a spring biased safe wheel. A user is able to hold a handle of the lighter and first rotate the safe wheel with his thumb with a certain force and then pull the trigger with his forefinger to ignite. A biasing force from the spring to rotate the safe wheel is adjusted to such an amount that children usually do not have, which, therefor, is able to significantly lower a possibility of unintentional ignition by child. This lighter has a main drawback. The safe wheel must have a coarse surface to insure a friction between skin of the user's thumb and the safe wheel. Often uses of such a lighter may hurt the skin of the user's thumb and make it coarse.

BRIEF SUMMARY OF THE INVENTION

The main object of the invention is to provide a child resistant lighter which is able to both lower a possibility of unintentional ignition by child and protect a skin of thumb of a user.

In order to accomplish the above object, the present invention provides a child resistant lighter having a handle which is hollow, a barrel mounted in the handle and extending outward, a fuel tank being within the handle and having a gas release nozzle, a piezoelectric unit contained in the handle and having a triggering button, an ignition means having an ignition button slidably mounted on the handle, a lever mounted on the fuel tank, a flame nozzle contained in the barrel, a fuel conveying hose connecting the flame nozzle and the gas release nozzle, and a safe means having a slidable button, a pivot, an arm mounted on the pivot and having a hole surrounding the transmission pole, and a second spring biasing the arm against the transmission pole. The ignition means further has a transmission pole slidable with respect to the handle, a first spring one end of which is fixed to the transmission pole and a free end of which is fixed to the handle, a first protrusion formed on the transmission pole, and a second protrusion formed on the ignition button. One end of the transmission pole being connected to the lever and the other end thereof meets the triggering button of the piezoelectric unit.

These and other objectives, features, and advantages of the present invention will become apparent from the following detailed description, the accompanying drawings, and the appended claims.

DETAILED DESCRIPTION OF THE PREFERRED EMBODIMENT

Figure 1:
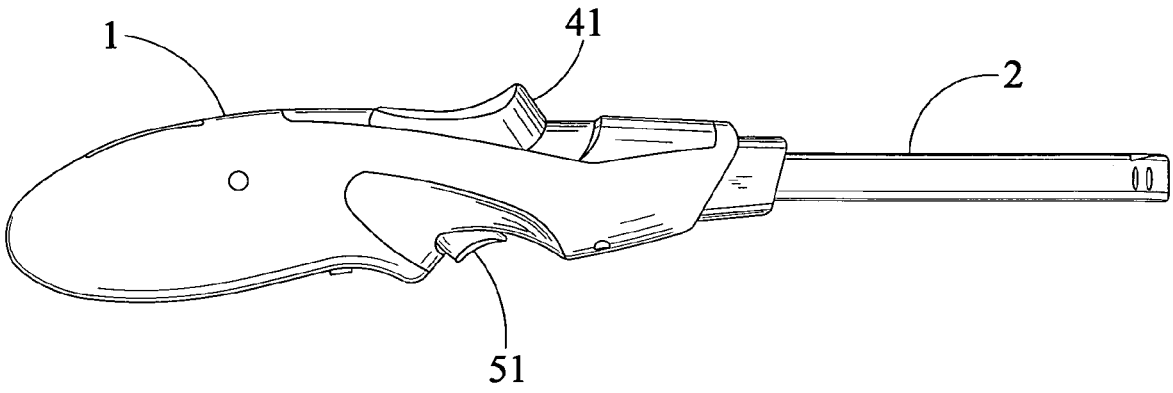
FIG. 1 is a perspective view of a preferred embodiment of the lighter of the invention.
Figure 4:
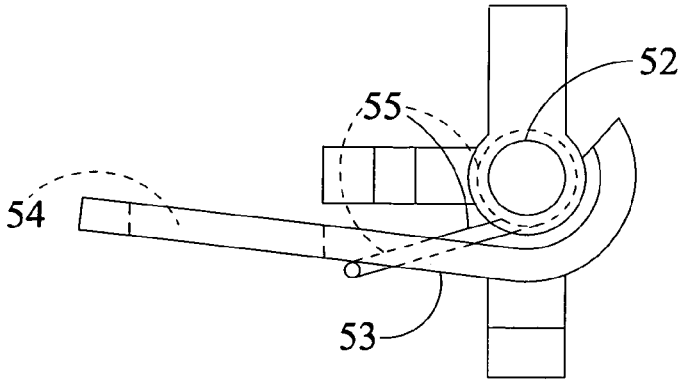
Figure 2:
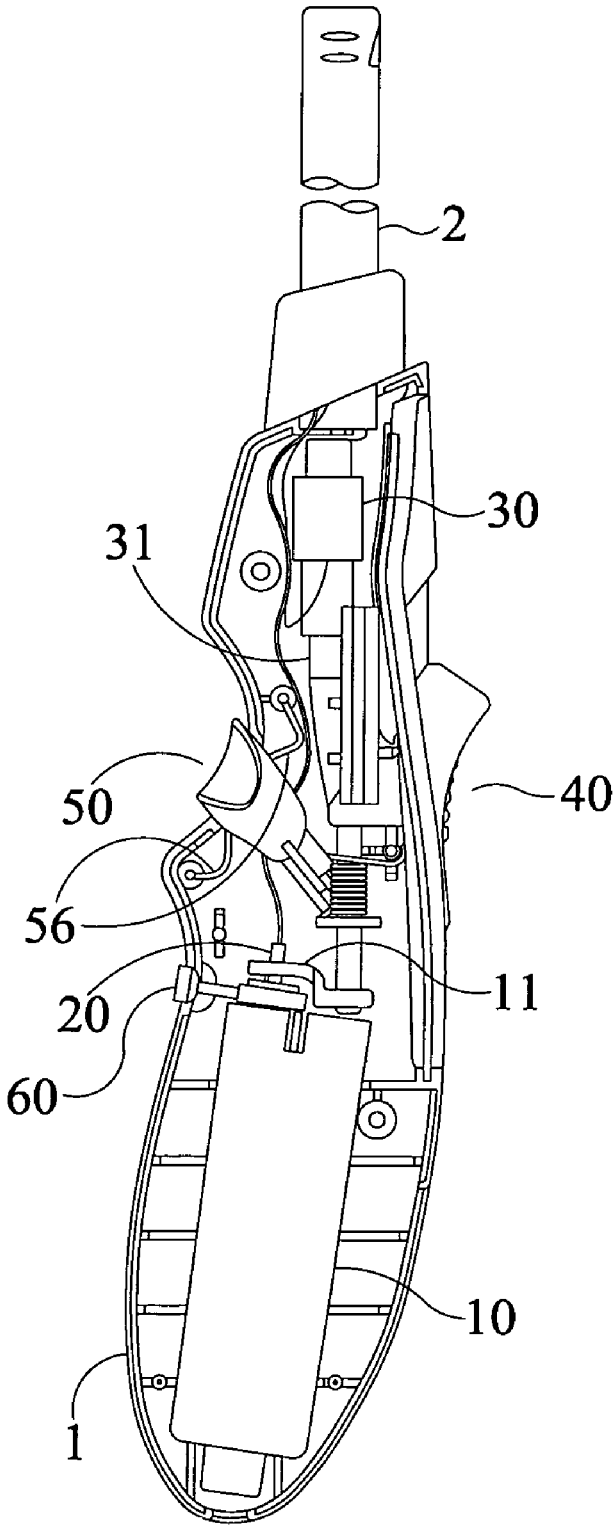
FIG. 2 is a partially exploded view of the lighter shown in FIG. 1.
Figure 3:
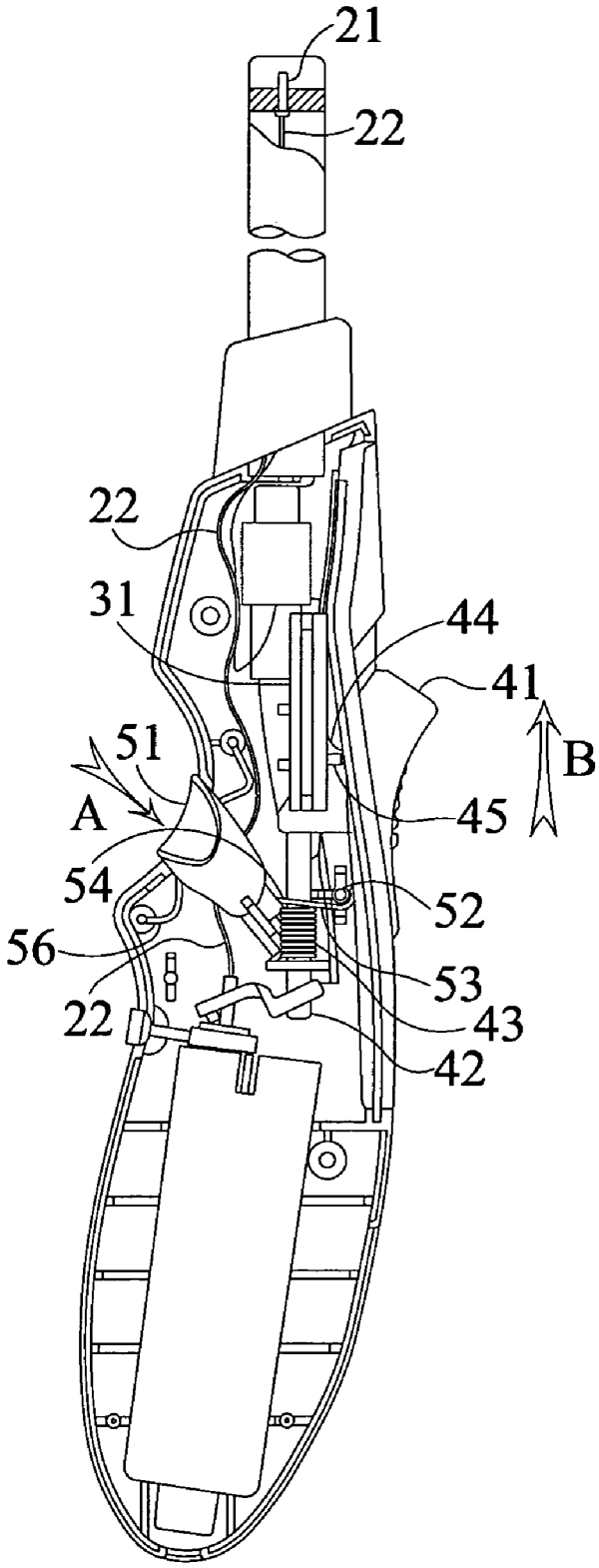
FIG. 3 is another partially exploded view of the lighter shown in FIG. 1. And, FIG. 4 is an enlarged flat view of a portion of a safe means of the embodiment shown in FIG. 1.

As shown in FIGS. 1, 2, 3 and 4, a preferred embodiment of a child resistant lighter of the invention is shown. The lighter has a handle 1, a barrel 2 mounted in the handle 1 and extending outward, a fuel tank 10 within the handle 1 and for containing liquefied gaseous fuel, a gas release nozzle 20 mounted on the fuel tank 10, a piezoelectric unit 30 contained in the handle 1 and having a triggering button 31 which when pressed downward, is able to startup the piezoelectric unit 30 to generate sparks for ignition, an ignition means 40 having an ignition button 41 slidably mounted on the handle 1, and a lever 11 mounted on the fuel tank 10. The gas release nozzle 20 is connected with a fire nozzle 21 contained in the barrel 2 by a fuel conveying hose 22. The gaseous fuel is able to be released from the flame nozzle 21 and then be ignited by the sparks generated from the piezoelectric unit 30.

The ignition means 40 also has a transmission pole 42 slidable with respect to the handle 1, a first spring 43 having one end fixed to the transmission pole 42 and a free end fixed to the handle 1, a first protrusion 44 formed on the transmission pole 42, and a second protrusion 45 formed on the ignition button 41. One end of the transmission pole 42 is connected to the lever 11 and the other end thereof meets the triggering button 31 of the piezoelectric unit 30. When the ignition button 41 is pushed along the direction B shown in FIG. 3, the second protrusion 45 formed thereon is able to push the first protrusion 44, thus the transmission pole 42 to move along the same direction against the biasing spring 43. The transmission pole 42 then uplifts the gas release nozzle 20 to release the gaseous fuel and at the same time depress the triggering button 31 of the piezoelectric 30 to startup the piezoelectric unit 30 to generate sparks. When such a pushing force is released, the transmission pole 42 moves back under a resuming force from the biasing spring 43 and the first protrusion 44 will push the second protrusion 45, thus the ignition button 41 to resume a position before it is pushed.

A safe means 50 is provided to insure that the ignition button 41 is only able to be moved with a force large enough. The safe means 50 has a slidable button 51, a pivot 52, an arm 53 mounted on the pivot and having a hole 54 surrounding the transmission pole 42, and a second spring 55 biasing the arm 53 against the transmission pole 42. When the arm 53 is biased against the transmission pole 42, a large friction exists between a surface of the transmission pole 42 and the surrounding hole 54. The ignition button 41 is not able to be moved in direction B when the pushing force is less than the friction.

The slidable button 51 is biased by a third spring 56 and meets the hole 54 of the arm 53. When the slidable button 51 is pressed downward in a direction A shown in FIG. 3 against the third spring 56, it rotates the arm 53 against the second spring 55, making the hole 54 leave the surface of the transmission pole 42. The friction disappears and the ignition button 41 will be easily pushed in the direction B. When the pushing force on the slidable button 51 is released, it resumes to a position that is not pressed under a force from the third spring 56. The arm 53 also resumes and the friction exists again.

A flame adjustment ring 60 may be provided. In use, a user is able to hold the handle 1 of the lighter of the invention with his one hand and then pull the slidable button 51 in direction A with his forefinger and push the ignition button 41 in direction B with his thumb at the same time. When the slidable button 51 is pressed down, the friction disappears and the ignition button 41 is easy to be moved. Once the slidable button 51 is released, the friction is generated and the ignition button 41 can only be moved with an amount greater than the friction. According to above description, it could be seen that before pulling the slidable button 51 with a force greater than a biasing force from the third spring 56, the lighter of the invention is difficult to ignite. The biasing force of the third spring 56 is able to be set at a certain amount which most children are not able to exert thus making the lighter safe to them. And meanwhile, the user does not have to move the safe wheel having a coarse surface, which will protect skin of his thumb.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A child resistant lighter having a handle which is hollow, a barrel mounted in said handle and extending outward, a fuel tank being within said handle and having a gas release nozzle, a piezoelectric unit contained in said handle and having a triggering button, an ignition means having an ignition button mounted on said handle, a lever mounted on said fuel tank, a flame nozzle contained in said barrel, and a fuel conveying hose connecting said flame nozzle and said gas release nozzle, wherein the improvements comprising:

said ignition means further having a transmission pole slidable with respect to said handle, a first spring one end of which is fixed to said transmission pole and a free end of which is fixed to said handle, a first protrusion formed on said transmission pole, and a second protrusion formed on said ignition button, with one end of said transmission pole being connected to said lever and the other end thereof meets said triggering button of said piezoelectric unit; and, a safe means having a slidable button, a pivot, an arm mounted on said pivot and having a hole surrounding said transmission pole, and a second spring biasing said arm against said transmission pole.

2. The child resistant lighter as claimed in claim 1, wherein said child resistant lighter further has a flame adjustment ring.

* * * * *